US005690499A

United States Patent [19]

Howell et al.

[11] Patent Number: 5,690,499

[45] Date of Patent: Nov. 25, 1997

[54] CARD EDGE SOCKET HAVING EXTRACTOR WITH CLOSED POSITION LOCK

[75] Inventors: David Gregory Howell, Madison; Ronald Louis Marion, Winston-Salem, both of N.C.

[73] Assignee: The Whitaker Corporation, Wilmington, Del.

[21] Appl. No.: 717,637

[22] Filed: Sep. 23, 1996

[51] Int. Cl.[6] ..... H01R 13/62

[52] U.S. Cl. ..... 439/157; 439/160

[58] Field of Search ..... 439/160, 152, 439/153, 155, 157, 159, 341, 372

[56] References Cited

U.S. PATENT DOCUMENTS 4,898,540 2/1990 Saito ..... 439/153

5,443,394 8/1995 Billman et al. ..... 439/157

5,445,531 8/1995 Billman et al. ..... 439/160

5,470,242 11/1995 Cheng et al. ..... 439/155

*Primary Examiner*—Gary F. Paumen

*Assistant Examiner*—Tho D. Ta

*Attorney, Agent, or Firm*—Robert J. Kapalka

[57] ABSTRACT

An electrical socket has a slot for receiving an edge of a circuit card and an extractor which is movable for dislodging the circuit card from the slot. The socket has a pair of flexible towers, and the extractor has a pair of lateral projections which are received in notches in the towers for locking the extractor in a closed position. The projections have beveled surfaces, and the towers have complementary ramps which are engaged by the beveled surfaces so that the towers are resiliently deflected without damage to the projections.

3 Claims, 5 Drawing Sheets

CARD EDGE SOCKET HAVING EXTRACTOR WITH CLOSED POSITION LOCK

FIELD OF THE INVENTION

The invention relates to an electrical socket which has a slot for receiving an edge portion of a circuit card, and an extractor at an end of the slot for dislodging the circuit card from the slot.

BACKGROUND OF THE INVENTION

There are shown in FIGS. 1 and 2 an end portion of a prior art card edge electrical socket with an extractor exploded away. Such a socket is sold by AMP Incorporated of Harrisburg, Pa. under part number 390055-6. The socket comprises a dielectric housing 2 made of thermoplastic material. The housing has an elongated slot 3 for receiving an edge portion of a circuit card (not shown), and the housing carries a plurality of contacts 4 which extend into the slot for electrically engaging corresponding contact pads on the circuit card. The illustrated socket is a direct insert socket as opposed to a cam-in type socket. The direct insert socket receives the circuit card along a straight insertion path, and the contacts 4 are deflected by a leading edge of the card as it is inserted into the slot. The deflected contacts generate a normal force on the card which gives rise to frictional resistance to movement of the card into or from the slot. This frictional resistance may be quite substantial and must be overcome to remove the card from the slot. In order to assist in card removal, an extractor 5 is provided at one or both ends of the slot 3. The extractor is pivotally mounted on an axis extending through journals 6 which are received in bores 7 in the housing. The extractor has a foot 8 which is disposed beneath the slot and is arranged to kick an end of the card out of the slot when the extractor is pivoted from a closed to an open position. The extractor has a lock mechanism to prevent inadvertent opening of the extractor. The lock mechanism comprises a pair of rounded projections 9 which extend from opposite sides of the extractor near the pivot axis of the extractor. The projections 9 are disposed in recesses 10 in walls 11 of the housing when the extractor is in the closed position, and the projections 9 are arranged to interfere with the walls 11 when the extractor is moved between the closed and open positions. Thus, the extractor is maintained in the closed position unless a sufficient force is applied to overcome the friction applied by the walls on the projections. However, a problem arises which affects reliability of the lock mechanism. The walls 11 are quite rigid because they are short and connected together by end wall 12 of the housing. As the projections slide along the walls 11, significant wear and skiving of plastic material occurs on both the projections and the walls. After the extractor has been cycled several times, resistance to movement of the extractor is greatly reduced, the extractor becomes floppy in the closed position, and secure locking of the extractor is compromised. There is a need for a socket having an extractor which overcomes these problems.

SUMMARY OF THE INVENTION

It is an object of the invention to improve the performance and increase the working life of an extractor lock mechanism on a card edge socket.

These and other objects are provided by an electrical socket comprising a dielectric housing having a top surface and an elongated slot which is open through the top surface and dimensioned to receive an edge of a circuit card, a plurality of contacts disposed along the slot for electrically connecting with the circuit card, a pair of towers extending upwardly from the top surface at an end of the slot, an extractor coupled to the housing proximate to the towers, the extractor being movable from a closed position to an open position to dislodge the circuit card from the slot, and the extractor and the towers having cooperable detent means for retaining the extractor in the closed position, wherein urging the extractor to the open position resiliently deflects the towers and overcomes the detent means.

In one embodiment the extractor is pivotally movable on an axis extending laterally with respect to an elongation direction of the slot, and the detent means comprises the extractor having a pair of oppositely extending projections which are engageable in respective notches in the towers.

BRIEF DESCRIPTION OF THE DRAWINGS

The invention will now be described by way of example with reference to the accompanying drawings wherein.

DETAILED DESCRIPTION OF THE PREFERRED EMBODIMENT

Figure 1:
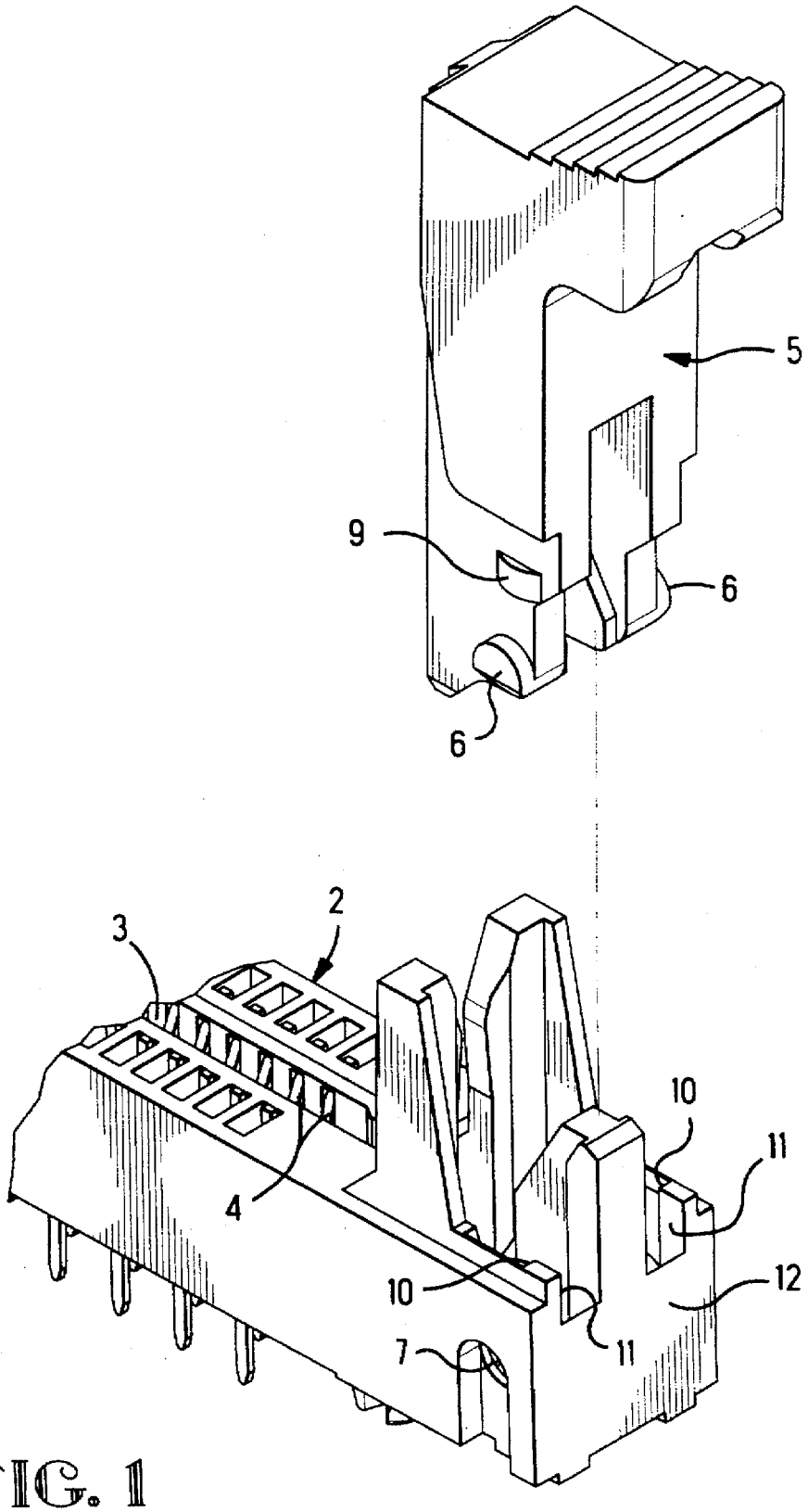
FIG. 1 Prior Art
FIGS. 1 and 2 are isometric views of an end portion of a prior art socket having an extrator exploded away.
Figure 2:
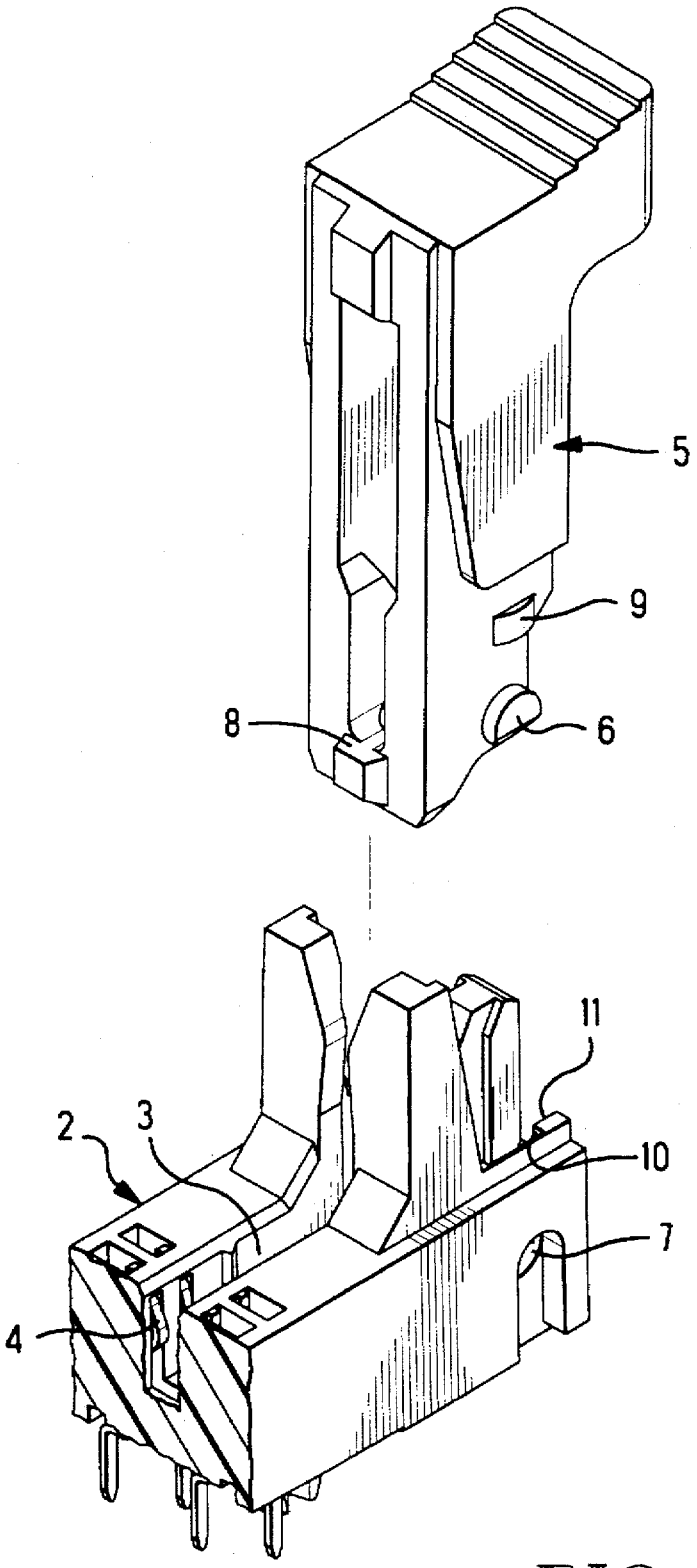
FIG. 2 Prior Art
Figure 3:
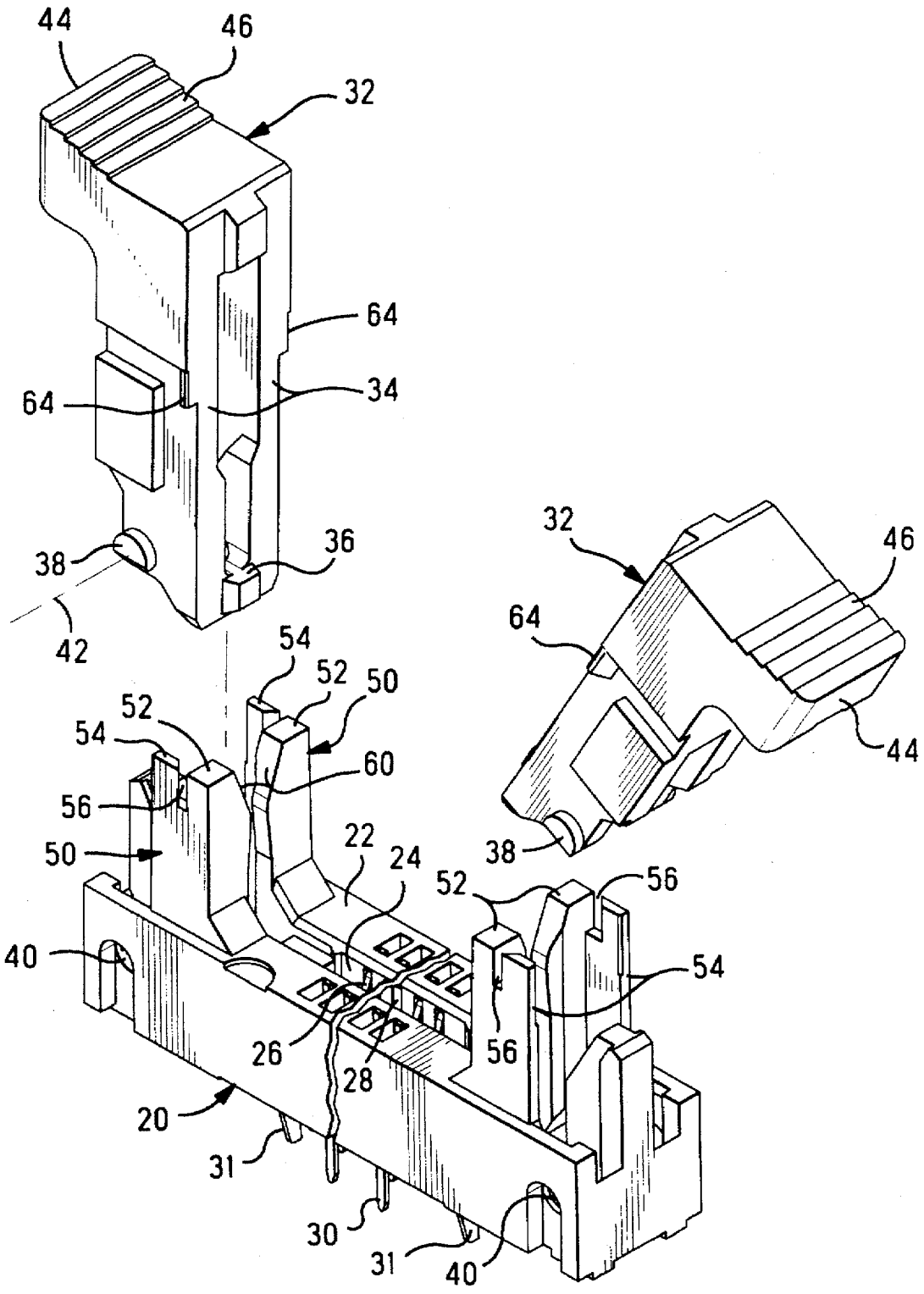
FIG. 3 is an isometric view of a socket according to the invention having extractors exploded away.
Figure 4:
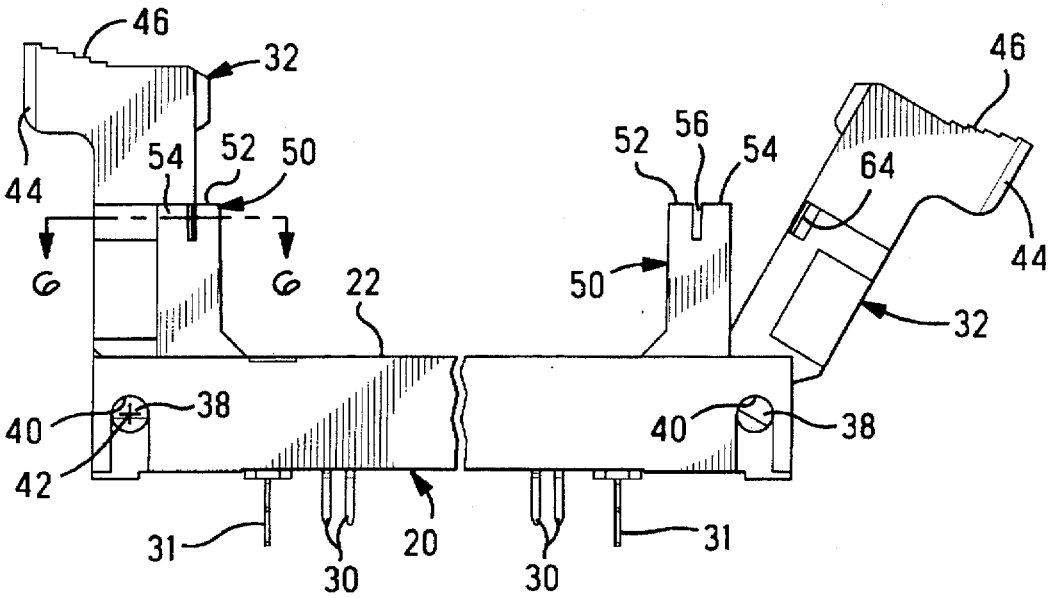
FIG. 4 is a side view of the socket with extractors mounted therein.

With reference to FIGS. 3 and 4, an electrical socket according to the invention comprises a dielectric housing 20 having a top surface 22 and an elongated slot 24 which is open through the top surface and is dimensioned for receiving an edge portion of a circuit board daughter card (not shown) such as a dual in-line memory module (DIMM). The housing carries a plurality of contacts 26 which are disposed in respective cavities 28 which are open through side walls of the slot 24. The contacts 26 are arranged in two rows on opposite sides of the slot and are spaced-apart along a length of the slot. The contacts extend into the slot through the side walls for electrically engaging contact pads on the daughter card which is received in the slot. Each of the contacts 26 has a solder tail lead 30 which extends exteriorly of the housing for electrical engagement with a circuit path on a mother board (not shown). The socket has boardlocks 31 which are engageable in holes in the motherboard for securing the socket thereto.

An extractor 32 is pivotally coupled to the housing 20 at each end of the slot 24, although the invention may embodied by the housing having only a single extractor. Each of the extractors 32 has a pair of legs 34 and a single foot 36 extending forwardly between the legs. As used herein with reference to each extractor, a front or forward direction is defined as a direction toward the slot 24. A pair of journals 38 extending laterally from the legs 34 are received in complementary bores 40 in the housing. Each of the extractors is pivotable between closed and open positions which are shown by the left and right extractors in FIG. 4, respectively. Each of the extractors pivots on an axis 42 extending through the journals 38 and oriented in a lateral direction with respect to the elongation direction of the slot 24. The extractor foot 36 is aligned in a plane of the slot so that it underlies an edge of the circuit card when the circuit card is installed in the slot and the extractor is in the closed position. Pivoting the extractor to the open position raises the foot and dislodges an end of the circuit card from the slot. The extractor has a finger grip 44 with a serrated or textured top surface 46 to facilitate finger operation of the extractor.

Figure 5:
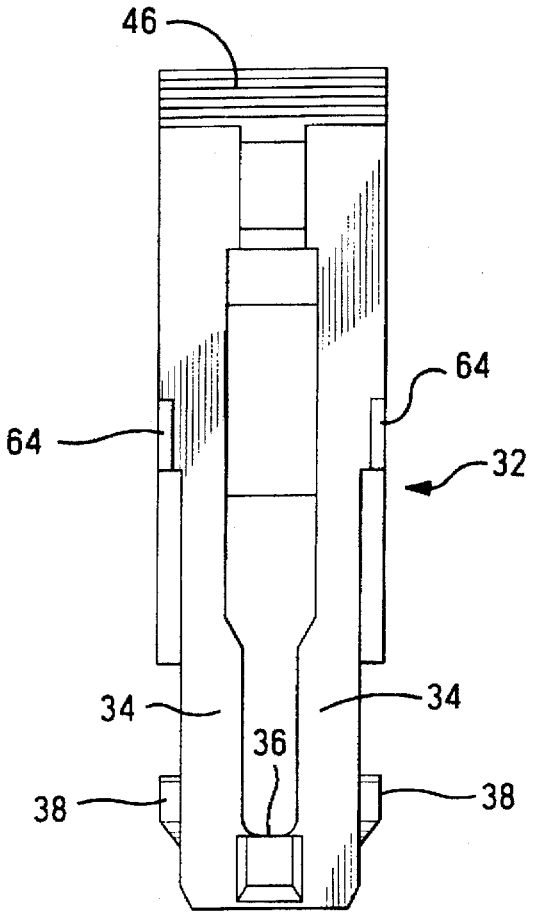
FIG. 5 is a front view of the extractor exploded from the socket.
Figure 5:
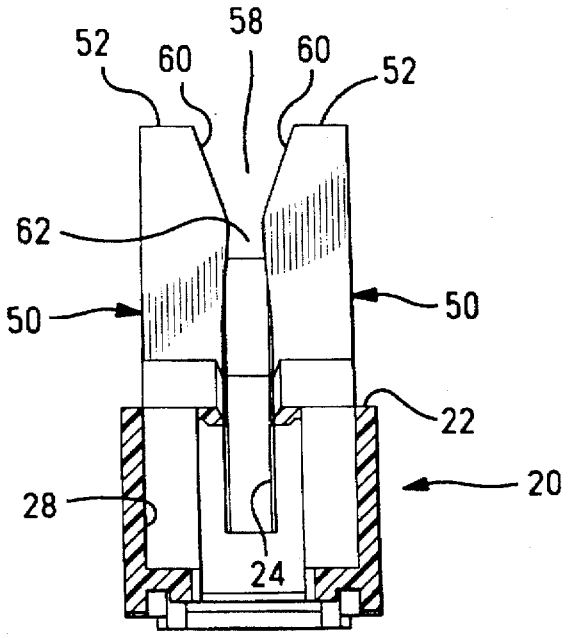

At each end of the slot 24 a pair of opposed towers 50 extend upwardly from the top surface 22 of the housing in association each of the extractors 32. Each pair of opposed towers provides a combination card guide and extractor lock. Each of the towers 50 has a stiff main beam 52 and a relatively thinner locking beam or tower 54 which extends rearwardly from the main beam 52 and is somewhat flexible. Each of the locking towers 54 has a notch 56 adjacent to the main beam 52, and this notch 56 contributes to flexibility of the locking tower 54. The main beams 52 are spaced apart so that a card guide channel 58 is provided between opposed surfaces 60 which converge to form a constriction 62, as best seen in FIG. 5. The guide channel 58 serves to guide the daughter card into the slot 24 during insertion, and the constriction 62 is dimensioned to stabilize the circuit card when an edge of the daughter card is received in the slot.

Figure 6:
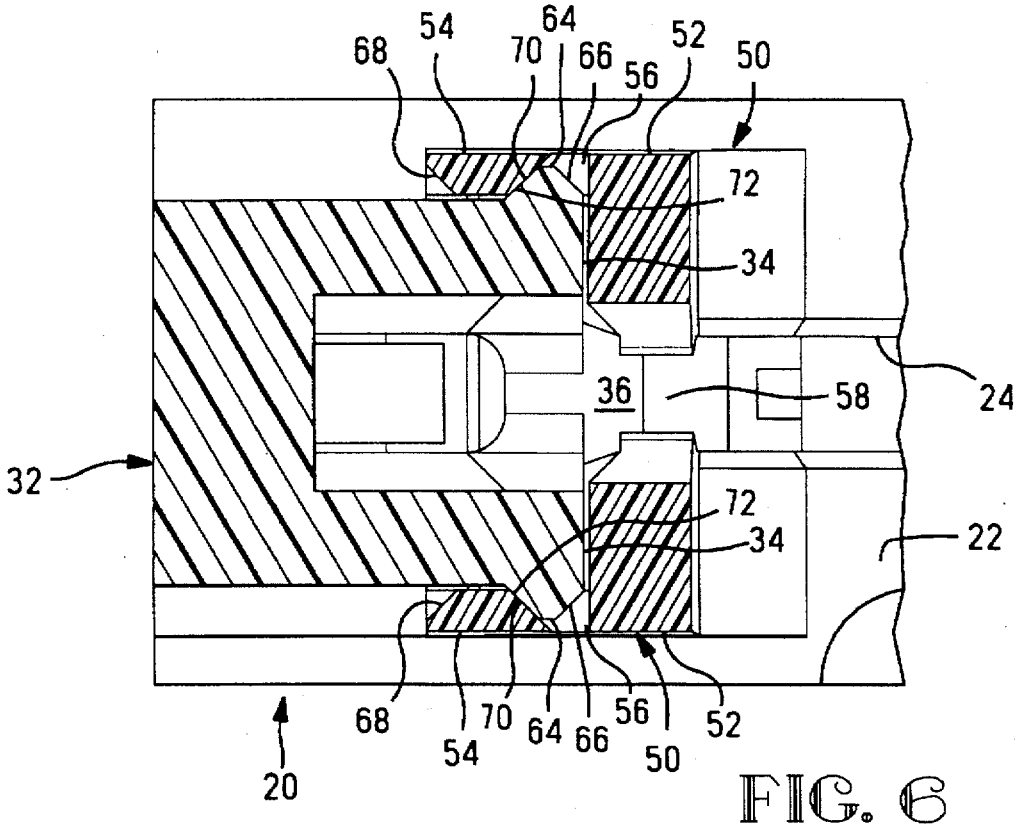
FIG. 6 is an enlarged cross-sectional view taken along line 6—6 of FIG. 4.

With further reference to the cross-sectional view of FIG. 6 wherein the extractor 32 is shown in the closed position, the extractor has a pair of lateral projections 64 which are dimensioned to interfere with the locking towers 54 and to be received in the notches 56. When the extractor is moved from the open to the closed position, the locking towers are deflected outwardly upon engagement of forward beveled surfaces 66 of the projections 64 with complementary ramps 68 of the locking towers 54. Upon full closure of the extractor, the projections 64 enter the notches 56 and the locking towers 54 resiliently return to their undeflected state with an audible click and a tactile indication through the extractor.

Each of the projections 64 has a rearward beveled surface 70 which is opposed by a complementary ramp 72 of the locking tower 54 at a rear edge of the notch 56. The rearward beveled surface 70 of the projection and the ramp 72 of the locking tower are preferably parallel to each other when they are in mutual engagement. Urging the extractor rearwardly to the open position causes the beveled surfaces 70 to wedge the locking towers outwardly, whereby the projections can pass between the towers.

The ramps 68 and 72 are smooth surfaces so that when the ramps are engaged by the respective beveled surfaces 66, 70 of the projections 64, the surfaces 66, 70 are not gouged by an edge or a sharp corner, and very little wear occurs on the projections 64.

The locking towers 54 are sufficiently stiff to prevent inadvertent opening of the extractor such as may be caused by shock, vibration or thermal expansion. The projections 64 and the notches 56 in the pair of towers 50 thus provide a cooperable detent means for retaining the extractor in the closed position.

The invention provides a socket having an improved extractor lock mechanism. The extractor locking towers are configured for more flexibility than prior art designs, and this flexibility reduces wear on the extractor projections so that the extractor can be cycled many times without a loss of locking strength. Also, the projections have been moved farther from the extractor pivot axis, thereby increasing the locking strength. Finally, the projections on the extractor have beveled surfaces which engage smooth ramps on the locking towers to minimize wear on the projections.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. An electrical socket comprising:

a dielectric housing having a top surface and an elongated slot which is open through the top surface and dimensioned to receive an edge of a circuit card, a plurality of contacts disposed along the slot for electrically connecting with the circuit card, a pair of towers extending upwardly from the top surface at an end of the slot, an extractor coupled to the housing proximate to the towers, the extractor being movable from a closed position to an open position to dislodge the circuit card from the slot, the extractor and the towers having cooperable detent means comprising projections which are engageable in respective notches for retaining the extractor in the closed position, wherein urging the extractor to the open position resiliently deflects the towers and overcomes the detent means, and each of the projections has a rearward beveled surface which is opposed by a complementary ramp of its respective said notch during movement of the extractor from the closed position to the open position.

2. The socket according to claim 1, wherein each of the projections has a forward beveled surface which is opposed by a complementary ramp of its respective said notch when the extractor is moved from the open to the closed position.

3. An electrical socket comprising:

a dielectric housing having a top surface and an elongated slot which is open through the top surface and dimensioned to receive an edge of a circuit card, a plurality of contacts disposed along the slot for electrically connecting with the circuit card, a pair of towers extending upwardly from the top surface at an end of the slot, an extractor coupled to the housing proximate to the towers, the extractor being movable from a closed position to an open position to dislodge the circuit card from the slot, the extractor and the towers having cooperable detent means comprising projections which are engageable in respective notches for retaining the extractor in the closed position, wherein urging the extractor to the open position resiliently deflects the towers and overcomes the detent means, and each of the projections has a forward beveled surface which is opposed by a complementary ramp of its respective said notch during movement of the extractor from the open position to the closed position.

* * * * *